United States Patent [19]

McNulty, Jr.

[11] Patent Number: 5,012,606

[45] Date of Patent: May 7, 1991

[54] SHOTGUN GUNLOCK

[76] Inventor: James F. McNulty, Jr., 1290 Third St., Calimesa, Calif. 92320

[21] Appl. No.: 388,538

[22] Filed: Aug. 1, 1989

[51] Int. Cl.[5] ..... F41A 17/06

[52] U.S. Cl. ..... 42/70.11; 361/194

[58] Field of Search ..... 42/70.11; 361/58, 86, 361/87, 194, 195, 196

[56] References Cited

U.S. PATENT DOCUMENTS 3,614,543 10/1971 Dick ..... 361/196

*Primary Examiner*—Charles T. Jordan
*Assistant Examiner*—Richard W. Wendtland
*Attorney, Agent, or Firm*—Leonard Tachner

[57] ABSTRACT

A solenoid current regulating circuit for use with shotgun gunlocks wherein the circuit provides a high activation current to flow momentarily to the coil so that the bolt of the solenoid controlled gunlock can be drawn back. However, upon continued depression of the activation switch, the circuit of the present invention automatically reduces the holding current to the solenoid coil so that the coil is protected from current damage. The circuit utilizes a resistor/capacitor network having an RC constant of less than one second for providing delayed biasing of a transistor which, when in its conductive state, reduces the gain of a current source transistor thereby reducing the current for the solenoid coil and thereby reducing the current flow through the coil of the solenoid to a level sufficient to hold the solenoid active and retain the bolt in its unlocked position. The reduced current flow will not permit the coil to be overheated and eventually opened by what otherwise would be a continuously high current.

6 Claims, 2 Drawing Sheets

SHOTGUN GUNLOCK

BACKGROUND OF THE INVENTION

1. Field of the Invention

The present invention relates generally to shotgun gunlocks of the type commonly found in police patrol vehicles and also called vertical electric riotgun holders designed for controlled transportation of shotguns and rifles wherein the gunlock prevents unauthorized removal of a shotgun or rifle without activation of an electrically operated solenoid lock which requires the use of the vehicle's ignition keys. The present invention relates more specifically to an improved shotgun gunlock, the improvement comprising a solenoid current regulating circuit designed to prevent solenoid coil damage due to excessive current flow which could otherwise open circuit the solenoid coil and thereby prevent desired removal of the shotgun or rifle in a life-threatening situation.

2. Prior Art

Shotgun gunlocks are well known in the art. They are used primarily in police patrol vehicles to secure the shotgun or rifle carried by such vehicles in a locked configuration. In this manner, if the police officers leave the vehicle, the shotgun or rifle cannot be removed by unauthorized persons who might otherwise use the rifle or shotgun either against the officers or innocent third parties. Typically, such shotgun gunlocks are solenoid activated to open upon the depression of an activation switch with the ignition switch of the vehicle turned on. Solenoid-activated rapid opening of the gunlock is imperative in order to obviate any significant time delay in an officer's access to the shotgun. Typically, such solenoid activated shotgun gunlocks utilize a door hinge which permits a thickly-walled, hardened metal locking bracket to engage a mounting bracket for encircling the forward portion of the gun's barrel with the gun positioned vertically and pointing towards the roof of the vehicle. Normally, a spring biased hinge bolt extends perpendicularly through the walls of the hinge and in this configuration, the hinge cannot be rotated. However, with the ignition switch of the vehicle in the ON position, depression of the activation switch energizes the solenoid coil which pulls the hinge bolt away from the hinge, thereby permitting the police officer to open the gunlock and remove the shotgun or rifle. Unfortunately, space for vertically installed shotgun locks is typically limited in a police car cab. Accordingly, the lock coils are generally small and subject to damage from their relatively high activation current. Furthermore, in the exigencies of situations requiring a shotgun, peace officers tend to hold the activation switch down for prolonged periods thereby causing prolonged excessive and potentially damaging current flow to the coil circuit. Unfortunately, once the coil burns open, the shotgun cannot be extracted. This could be a serious and life threatening problem with present gunlocks.

There is therefore a need for a solenoid circuit which can apply the necessary high activation current to draw back the bolt from the hinge to enable the police officer to open the gunlock, but which then reduces the current to a lower level holding current which enables the bolt to be retained outside the hinge while the officer continues to depress the activation switch. In this manner, no damage can occur to the solenoid coil which would otherwise burn open and allow the bolt to reenter the hinge, locking the shotgun in place and making it inaccessible to the officer.

SUMMARY OF THE INVENTION

The present invention solves the aforementioned need by providing a solenoid current regulating circuit for use with shotgun gunlocks wherein the circuit provides a high activation current to flow momentarily to the coil so that the bolt of the solenoid controlled gunlock can be drawn back. However, upon continued depression of the activation switch, the circuit of the present invention automatically reduces the holding current to the solenoid coil so that the coil is protected from current damage. The circuit utilizes a resistor/-capacitor network having an RC constant of less than one second for providing delayed biasing of a transistor which, when in its conductive state, reduces the gain of a current source transistor thereby reducing the current for the solenoid coil and thereby reducing the current flow through the coil of the solenoid to a level sufficient to hold the solenoid active and retain the bolt in its unlocked position. The reduced current flow will not permit the coil to be overheated and eventually opened by what otherwise would be a continuously high current. Thus, the circuit of the present invention permits the peace officer to continue to depress the activation switch which applies current to the solenoid oil, thereby making it possible to unlock the gun-lock and remove the shotgun whenever desired. This can be done without incurring the problem found in the prior art, namely, inadvertently burning open the solenoid coil which would otherwise relock the gunlock thereby making it impossible for the peace office to remove the gun.

OBJECTS OF THE INVENTION

It is therefore, a principal object of the present invention to provide an improved shotgun gunlock which permits long term continued activation of the solenoid coil which unlocks the gunlock, but without incurring continuously high coil-damaging current which would otherwise permit the gunlock to inadvertently relock and prevent removal of the gun.

It is an additional object of the present invention to provide an improved shotgun gunlock having a solenoid current regulating circuit which provides a high activation current to flow momentarily to activate the coil for removing the bolt from the door hinge of the gunlock and then automatically provides for a reduction in current to permit continual activation of the solenoid without incurring inadvertent damage of the gunlock solenoid coil which would otherwise relock the gunlock and prevent removal of the gun.

It is still an additional object of the present invention to provide an improved shotgun gunlock solenoid current regulating circuit for a gunlock of the type that uses a solenoid activated unlocking device such as a moveable spring-biased hinge-locking bolt, the improvement comprising an RC network time delay current reduction circuit for permitting full current application to the solenoid to withdraw the bolt from the hinge to permit opening of the gunlock and subsequent reduction in current to a holding level which permits continued retention of the bolt in a removed position while preventing inadvertent damage to the solenoid coil which would otherwise release the bolt and relock the gunlock.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
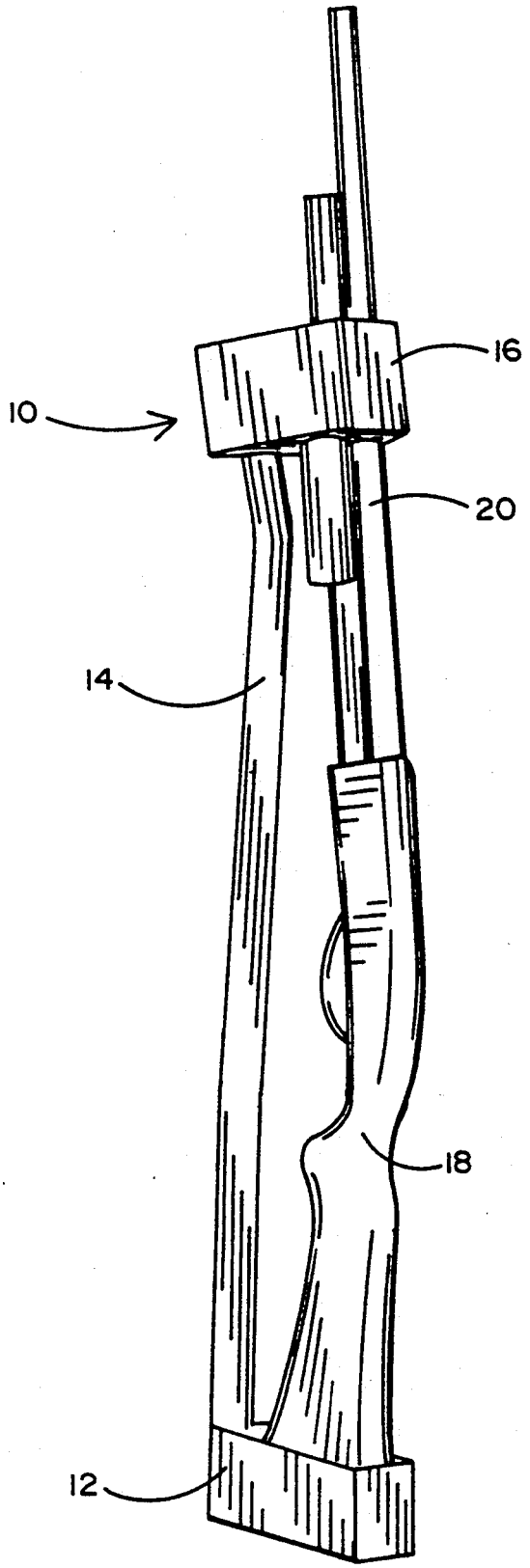
FIG. 1 is a prior art representation of a typical gunlock and gun configuration with which the present invention may be used.

As shown in FIG. 1, a shotgun gunlock 10 of the present invention comprises a butt-holding bracket 12, a vertical support 14 and a locking assembly 16. These three members 12, 14 and 16 are designed to hold a shotgun 18 in a locked, vertical position with the locking assembly 16 firmly secured in locking engagement with the gun barrel 20 of shotgun 18. As seen best in FIG. 2, the locking assembly 16 comprises a mounting bracket 22 and a door 24, the combination of which when fully closed surrounds the gun barrel 20 in a manner which precludes removal of the shotgun 18 from the but-holding bracket 12. The mounting bracket 22 and door 24 are hingedly interconnected by a hinge housing 26 which includes a lockable hinge 28 (see FIG. 3). When the door 24 and mounting bracket 22 are in their fully closed position, the hinge housing 26 is aligned with a hinge locking bolt 30 (see FIG. 3) the position of which determines, whether or not, the door 24 may be opened, thereby permitting removal of the gun 18 from the gunlock 10. The status of hinge locking bolt 30 is determined by the current regulating circuit 25 of FIG. 3 which will now be discussed.

Figure 2:
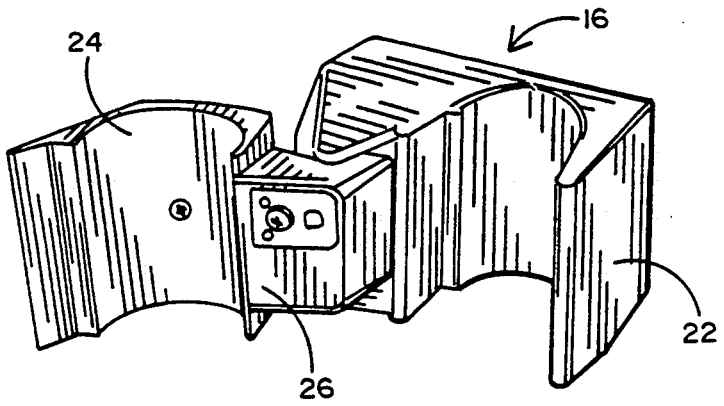
FIG. 2 is an isometric view of a prior art gunlock mechanism showing the hinged configuration thereof.
Figure 3:
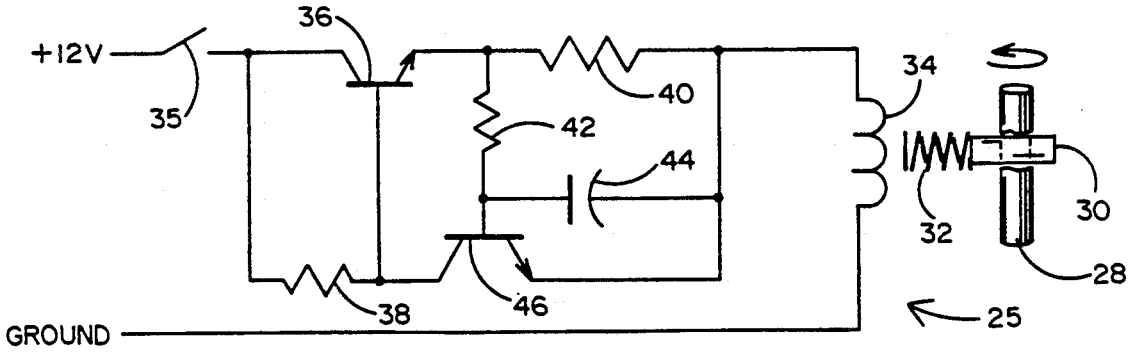
FIG. 3 is a schematic circuit of the solenoid current regulating circuit of the present invention.

Referring now to FIG. 3, it will be seen that the hinge locking bolt 30 protrudes through hinge 28 in its nominal locked configuration thereby preventing turning of the hinge 28 which would otherwise permit opening the door 24 of FIG. 2. As also seen in FIG. 3, the hinge locking bolt 30 is connected to a spring 32 which biases the position of the hinge locking bolt so that it is in its locking position extending through hinge 28 unless forcefully withdrawn therefrom by the action of solenoid coil 34 which is in intimate juxtaposition with the hinge locking bolt 30 and which forms a part of the current regulating circuit 25.

Current regulating circuit 25 is connected between the regulated 12 volt source in the vehicle to which the shotgun gunlock 10 is connected and is also connected to the vehicle's chassis ground. The vehicle's ignition and an activation switch 35 are also connected into the current regulating circuit 25 so that solenoid current can only be applied to solenoid coil 34 when the vehicle's ignition switch is turned ON and activation 35 is depressed. Circuit 25 also comprises a current regulating transistor 36, a 270 Ohm resistor 38, a 1 Ohm resistor 40, a time delay (1K Ohm) resistor 42, a time delay (200 MFd) capacitor 44 and a biasing transistor 46. Transistor 36 may be a model TIP102 transistor and transistor 46 may be a Model MPS2222 transistor.

When the activation switch 35 is closed with the ignition on, current on the order of about 40 milliAmps is caused to flow through the resistor 38 to the base terminal of transistor 36, thereby biasing ON the transistor 36 with a current gain of approximately 50. This causes current to flow in the collector-to-emitter circuit of transistor 36 through the resistor 40 and into the solenoid coil 34. The magnitude of this current is approximately 2 Amperes. This current of 2 Amperes is sufficient to activate the withdrawal of hinge locking bolt 30 from hinge 28 against the compressive force of spring 32 thereby permitting the unlocking of door 24 from mounting bracket of FIG. 2. It will be understood that until current of this magnitude flows through coil 34, the tension spring 32 keeps the bolt 30 forward in the door hinge and door 24 cannot be opened.

At this point in time, transistor 46 is biased off and the base-to-emitter bias voltage of transistor 36 is determined by the voltage drop across resistor 38 with current flow limited to the path between the agitation switch 35 and the base-to-emitter junction of transistor 36. However, as current flow continues through the solenoid coil 34 at the 2 Amp level, capacitor 44 begins charging through 1K Ohm resistor 42, gradually forward biasing the base-to-emitter junction of transistor 46 and eventually permitting current to flow in the collector-to-emitter path of transistor 46. Such current flow will, of course, reduce the bias voltage from the base-to-emitter of transistor 36, thereby significantly reducing its current gain and thus lowering the current that flows through solenoid coil 34.

Thus, in summary, circuit 25 permits a high activation current to flow momentarily through transistor 36 to the coil 34, the bolt 30 is drawn back, the capacitor 44 charges through the resistor 42 and eventually activates transistor 46. As a result, a reduced holding current of approximately ½ Ampere then flows through coil 34. Consequently, the coil is protected from current damage despite the fact that the activation switch 35 is held in its closed position for a protected period of time and the bolt 30 is retained in its withdrawn position thereby permitting the police officer to remove the gun from the gunlock. Upon release or opening of switch 35, current through coil 34 ceases and spring 34 reextends bolt 30 through the hinge 28. Thereafter, each time the switch 35 is depressed or closed, the aforementioned momentary flow of high activation current to withdraw the bolt and subsequent reduced holding current to retain the bolt flows through coil 34.

The reduced holding current is selected to be sufficiently low in magnitude to preclude damage to the coil 34 irrespective of the time period over which the holding current is caused to flow through the coil. Consequently, the peace officer may, if he chooses for strategic reasons, continue to depress the activation switch 35 for virtually any period of time thereby unlocking the gunlock. Despite not opening door 24 of FIG. 2, the officer can be confident in the knowledge that because of the current regulating effect of the circuit of the present invention, that door 24 will remain openable at any time the officer chooses to open it and remove the gun. Accordingly, the aforementioned problems of the prior art are avoided by means of the present invention.

It will now be understood that what has been disclosed herein, comprises an improved shotgun gunlock of the type used by police officers for controlled transportation of shotguns and rifles. More specifically, the present invention comprises an improved lock solenoid circuit for regulating the current through the solenoid coil of such a lock whereby upon depression of the activation switch for removing a locking bolt from the hinge of the lock, a high current, sufficient in magnitude to remove the bolt from the hinge is provided momentarily and thereafter a reduced holding current is provided for retaining the bolt in its removed position until the police officer decides to either release the activation switch to relock the gunlock or open the door and remove the gun.

Those having skill in the art to which the present invention pertains, will now, as a result of the applicant's teaching herein, perceive various modifications and additions which may be made to the invention. By way of example, the specific circuit technique incorporated herein in a preferred embodiment for generating a momentarily higher level of current through the solenoid coil and thereafter a reduced level of current, may be modified or replaced by an alternative circuit which accomplishes the same result in a different manner. Accordingly, all such modifications and additions are deemed to be within the scope of the invention which is to limited only by the claims appended hereto.

I claim:

1. An improved shotgun gunlock of the type used in police vehicles for securing a shotgun or rifle for selective release upon activation of a solenoid coil-controlled locking device; the improvement comprising:

a solenoid coil current regulating circuit having means for causing a first current to flow momentarily through said solenoid coil for unlocking said locking device and having means for automatically causing a second current to flow continuously through said solenoid coil for retaining said locking device in an unlocked configuration;

said second current being smaller in magnitude than said first current for preventing damage to said solenoid coil;

said first current causing means comprises a current source transistor connected in series with said solenoid coil; and said second current causing means comprises an RC network and a biasing transistor, said RC network being connected to charge up over a selected period of time as a result of current flow through said solenoid coil, said biasing transistor being connected to respond to the charge on said RC network to reduce the gain of said current source transistor for reducing the current through said solenoid coil.

2. The improvement recited in claim 1 wherein said locking device comprises a hinged door and an extendable bolt mechanically biased by a spring to extend perpendicularly through the door hinge to prevent rotation of the hinge when said door is locked and a solenoid positioned for withdrawing said bolt from said hinge when said first current flows through said solenoid coil for allowing rotation of said hinge and unlocking said door.

3. The improvement recited in claim 1 wherein said first current is about 2 Amperes and said second current is about 0.5 Amperes.

4. A solenoid current source comprising a first momentary current generating means for activating a solenoid and a second continuous current generating means for maintaining the solenoid in an activated condition; the current of said second means being lowered than the current of said first means for preventing current-induced damage to said solenoid;

said first current generating means comprises a current source transistor connected in series with said solenoid coil; and said second current generating means comprises an RC network and a biasing transistor, said RC network being connected to charge up over a selected period of time as a result of current flow through said solenoid, said biasing transistor being connected to respond to the charge on said RC network to reduce the gain of said current source transistor for reducing the current through said solenoid coil.

5. The improvement recited in claim 4 wherein said first current is about 2 Amperes and said second current is about 0.5 Amperes.

6. The current source recited in claim 4 wherein said RC network has a time constant of less than about one second.

* * * * *